US006877431B2

(12) United States Patent
Heeke

(10) Patent No.: US 6,877,431 B2
(45) **Date of Patent: *Apr. 12, 2005**

(54) HERMETICALLY SEALED ELECTRICAL FEED-THROUGH DEVICE WITH A BENT ISOLATED PIN IN A CIRCULAR GLASS SEAL

(75) Inventor: Neil Heeke, Golden, CO (US)

(73) Assignee: Schott Glas, Mainz (DE)

( * ) Notice: Subject to any disclaimer, the term of this patent is extended or adjusted under 35 U.S.C. 154(b) by 238 days.

This patent is subject to a terminal disclaimer.

(21) Appl. No.: 10/279,492

(22) Filed: Oct. 21, 2002

(65) Prior Publication Data

US 2004/0079545 A1 Apr. 29, 2004

(51) Int. Cl.[7] ..... F42B 5/145; F42C 11/00; F42C 19/06; F42C 19/12

(52) U.S. Cl. ..... 102/202.12; 102/202; 102/202.5; 102/202.9

(58) Field of Search ..... 102/202.9, 202.12, 102/202; 174/50.56; 280/737; 208/741; 361/247, 302; 428/621; 65/36

(56) References Cited

U.S. PATENT DOCUMENTS

| | | | | | |
|---|---|---|---|---|---|
| 372,046 | A | * | 10/1887 | Stuart | 102/202.9 |
| 4,430,376 | A | | 2/1984 | Box | 428/174 |
| 4,648,319 | A | * | 3/1987 | Westerlund et al. | 102/202.12 |
| 4,678,358 | A | | 7/1987 | Layher | 403/28 |
| 4,788,382 | A | | 11/1988 | Ahearn et al. | 174/52.4 |
| 5,157,831 | A | * | 10/1992 | Wang et al. | 29/876 |
| 5,243,492 | A | | 9/1993 | Marqui et al. | 361/247 |
| 5,367,125 | A | * | 11/1994 | Viret et al. | 174/52.4 |
| 5,556,132 | A | * | 9/1996 | Sampson | 280/741 |
| 5,709,724 | A | | 1/1998 | Naugler et al. | 65/59.4 |
| 5,772,243 | A | | 6/1998 | Green et al. | 280/741 |
| 6,274,252 | B1 | | 8/2001 | Naugler et al. | 428/621 |
| 6,446,557 | B1 | * | 9/2002 | Lubbers | 102/202.9 |

FOREIGN PATENT DOCUMENTS

| | | | | |
|---|---|---|---|---|
| FR | 2560983 A1 | * | 9/1985 | F42C/19/12 |
| FR | 2560984 A1 | * | 9/1985 | F42B/3/14 |

* cited by examiner

*Primary Examiner*—Michael J. Carone
*Assistant Examiner*—Daniel L. Greene, Jr.
(74) *Attorney, Agent, or Firm*—Michael J. Striker

(57) ABSTRACT

The hermetically sealed electrical feed-through device has a circular metal disk (11) with a conductive angular or bent isolated pin (13) hermetically sealed in an oval or elliptical through-going opening (O) whose center coincides with the center of the circular metal disk. The angular or bent isolated pin (13) is sealed in the oval or elliptical opening (O) by means of a glass-to-metal seal (17). An angular or bent ground pin (15) is connected to the rear side of the circular metal disk (11) adjacent to the opening (O) and extends approximately parallel to the isolated pin (13). Because the through-going opening (O) has an elliptical or oval cross-section section, different bridge wires of different lengths are connectable on the front side of the metal disk (11) between the front surface of the circular metal disk (11) and the angular or bent isolated pin (13). The isolated and ground pins both have circular transverse cross-sections.

5 Claims, 1 Drawing Sheet

HERMETICALLY SEALED ELECTRICAL FEED-THROUGH DEVICE WITH A BENT ISOLATED PIN IN A CIRCULAR GLASS SEAL

CROSS-REFERENCES

The present invention contains subject matter in common with a co-pending U.S. Patent Application entitled: HERMETICALLY SEALED ELECTRICAL FEED-THROUGH DEVICE WITH A STRAIGHT ISOLATED PIN IN AN OFFSET OVAL GLASS SEAL and another co-pending U.S. Patent Application entitled: HERMETICALLY SEALED ELECTRICAL FEED-THROUGH DEVICE WITH AN OVAL-CROSS-SECTIONED ISOLATED PIN IN A CIRCULAR GLASS SEAL, filed on or about the same time as the present application.

BACKGROUND OF THE INVENTION

1. Field of the Invention

The present invention relates to a hermetically sealed electrical feed-through device, especially for an initiator or squib of an air bag igniter.

2. Description of the Related Art

Air bag systems used for protecting the passengers of a motor vehicle during a collision include an inflatable bag mounted in the dashboard or steering wheel, gas generators for the explosive generation of gas to inflate the bag, acceleration sensors to generate an electrical signal indicative of a collision and an igniter responsive to the acceleration sensors for ignition of a trigger charge in a hollow chamber that, in turn, ignites a main charge to produce the gas that inflates the bag.

The igniter for an air bag system comprises a so-called header or squib. The squib or header, as described for example in U.S. Pat. No. 5,243,492 and U.S. Pat. No. 5,772,243, comprises a hermetically sealed electrical feed-through device for supplying a current into the hollow chamber containing the trigger charge and a thin bridge wire electrically connected across the electrical feed-through device. The bridge wire ignites the trigger charge when a sufficient electrical current is passed through it via the feed-through device. Hermetically sealed electrical feed-through devices are also used for other types of devices.

In methods of manufacturing the hermetically sealed electrical feed-through devices of the prior art, as described in U.S. Pat. No. 5,709,724, U.S. Pat. No. 6,274,252, U.S. Pat. No. 5,243,492, U.S. Pat. No. 5,157,831, U.S. Pat. No. 4,678,358 and U.S. Pat. No. 4,430,376, a metal isolator body or plug is provided with a circular through-going opening or a metal eyelet is provided with a circular cavity. A conductive pin, called the isolated pin, is hermetically sealed in the through-going opening or cavity by means of a glass-to-metal seal.

Glass-to-metal seals may be of the compression variety, in which advantage is taken of the difference in the thermal expansion properties of metal and glass, or may be due to molecular bonding, as described in U.S. Pat. No. 5,709,724 and U.S. Pat. No. 6,274,252.

A hermetically sealed feed-through device is made with a glass-to-metal compression seal by cutting an appropriately sized glass preform having a suitable coefficient of thermal expansion with a central hole, arranging the glass preform in a through-going opening in a metal disk or in a cavity in a metal eyelet, inserting the conductive isolated pin in the hole in the preform, heating the assembly to an elevated temperature over the softening point of the glass perform and then cooling the entire assembly, whereby the metal disk or eyelet contracts more than the glass. A ground pin may be connected to the metal disk or the eyelet approximately parallel to the isolated pin as described in U.S. Pat. No. 5,243,492.

The isolated pin and/or the ground pin may also be provided with a noble metal coating to protect against corrosion, as described in U.S. Pat. Nos. 4,788,382 and 5,157,831.

The resulting electrical feed-through devices can be used to make the headers or squibs for the air bag igniter, for example, by connecting the bridge wire across the glass seal between the isolated pin on the front side of the electrical feed-through device and the body of the eyelet or metal disk.

The conductive pins in the prior art electrical feed-through devices are circular cross-sectioned and the through-going opening or cavity in the prior art metal ring or eyelet is circular. Disadvantageously only bridge wires of a comparatively narrow range of lengths can thus be connected across the front side of the electrical feed-through device to make a squib or initiator, e.g. for an air bag, because the isolated pin is placed centrally in the through-going opening in the metal ring or eyelet during assembly. Thus different embodiments of the electrical feed-through devices with different sized through-going openings and different diameter isolated pins must be manufactured e.g. for different air bag system manufacturers or for different initiator or squib manufacturers. This results in comparatively large manufacturing costs including storage, distribution and fixturing expenses, because of the various different types of hermetically sealed electrical feed-through devices for the different initiators.

SUMMARY OF THE INVENTION

It is an object of the present invention to provide an improved hermetically sealed electrical feed-through device, especially for an initiator or squib for an air bag ignition system, which does not suffer from the above-described disadvantages.

It is also an object of the present invention to provide a universal hermetically sealed electrical feed-through device for an initiator or squib for an air bag inflation system of the above-described type having at least one bridge wire, that accommodates a greater range of bridge wire lengths, so that different manufacturers of squibs or initiators having different bridge wire requirements can use the same embodiment of the electrical feed-through device according to the invention.

It is another object of the invention to provide a hermetically sealed electrical feed-through device of the above-described type in which a conductive pin is sealed in a through-going opening by means of a glass seal, in which strain distribution is uniform throughout the glass seal.

According to the invention a hermetically sealed electrical feed-through device comprises an electrically conductive body with an oval or elliptical through-going opening, which has a front side and a rear side and in which the oval or elliptical through-going opening is positioned so that the center of the oval or elliptical through-going opening approximately or exactly coincides with the center of the electrically conductive body;

an electrically conductive angular or bent isolated pin hermetically sealed centrally in the oval or elliptical through-going opening by means of a glass seal, so that the angular or bent isolated pin projects outward from the rear side of the electrically conductive body and so that one end of the angular or bent isolated pin is accessible from or exposed on the front side of the electrically conductive body; and an electrically conductive angular or bent ground pin connected with the rear side of the electrically conductive body adjacent to the oval or elliptical through-going opening, the electrically conductive angular or bent ground pin having a substantially identical shape as the angular or bent isolated pin and projecting outward from the rear side of the electrically conductive body approximately parallel to the isolated pin;

wherein the oval or elliptical through-going opening has a major axis and a minor axis such that different bridge wires of different lengths are connectable between the front side of the electrically conductive body and the one end of the isolated pin accessible from or exposed on the front side of the electrically conductive body.

The electrical feed-through device according to the invention has the great advantage that it permits a wider range of bridge wire lengths for one or more bridge wires connected across the front side of the feed through-devices because the through-going opening in the electrically conductive body has an oval or elliptical cross-section. The manufacture of a single type of electrical feed-through device thus accommodates the needs of a large number of different manufacturers who use the electrical feed-through device to e.g. manufacture squibs or initiators for inflation devices for air bags. A lower price for the feed-through device results because of the higher volumes due to reduced component types.

In addition, the same length bridge wire can advantageously be welded in each of the four quadrants of the glass seal. Double bridge wires can easily be welded simultaneously. Furthermore the symmetrical shape of the seal area produces balanced strain distribution in the glass. A thinner head can be produced with a glass seal having the same or greater strength.

In a preferred embodiment of the invention the electrically conductive body is a circular metal disk, or eyelet, and the angular isolated pin and the angular ground pin consist of metal and have a circular transverse cross-section, so that manufacture of the feed-through device is simplified.

The angular or bent ground pin is preferably shortened relative to the isolated pin, so that free ends of the isolated pin and the ground pin are exactly or approximately the same distance from the rear side of the circular metal disk.

The exposed end surface of the isolated pin, the front surface of the glass seal and the front surface of the circular metal disk are preferably at least approximately even with each other or at least approximately coplanar.

Manufacture and assembly of the electrical feed-through device is comparatively easier because the isolated pin and the ground pin may be the same as in some embodiments of the prior art feed-through. The opening in the glass preform used to make the glass seal advantageously may be the same diameter as in the glass preform of the prior art, but the outside shape of the glass preform is changed to elliptical or oval.

Fixturing costs will be reduced due to the fewer types of embodiments. Raw material costs are reduced because cold forming or metal injection molding can be used to make the circular metal disk or eyelet. Also the higher component production quantities reduce raw material costs.

BRIEF DESCRIPTION OF THE SEVERAL VIEWS OF THE DRAWING

The objects, features and advantages of the invention will now be illustrated in more detail with the aid of the following description of the preferred embodiments, with reference to the accompanying figures in which.

DETAILED DESCRIPTION OF THE INVENTION

Figure 1:
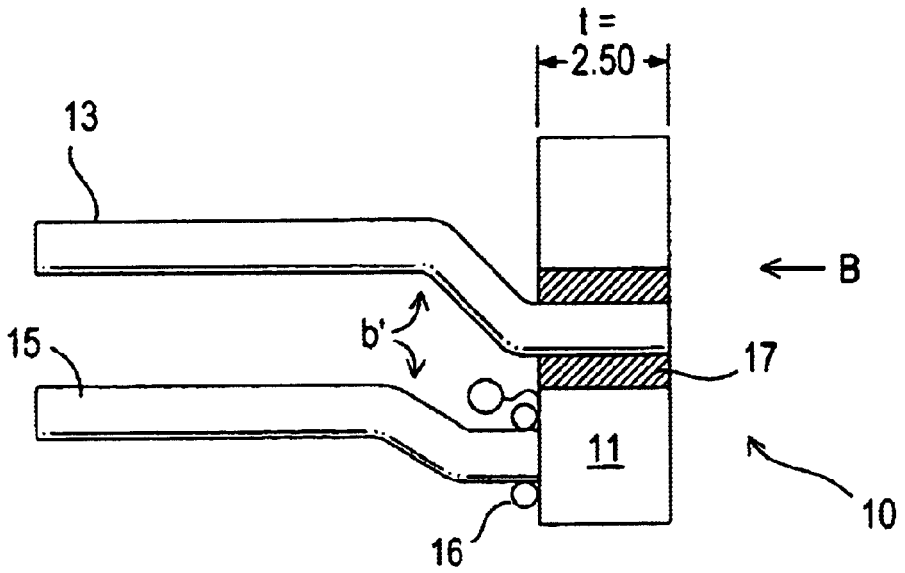
FIG. 1 is a longitudinal cross-sectional view through a first embodiment of the electrical feed-through device according to the invention taken along the section line A—A in FIG. 2.

A single bent pin embodiment of the electrical feed-through according to the invention is shown in the drawing.

Figure 2:
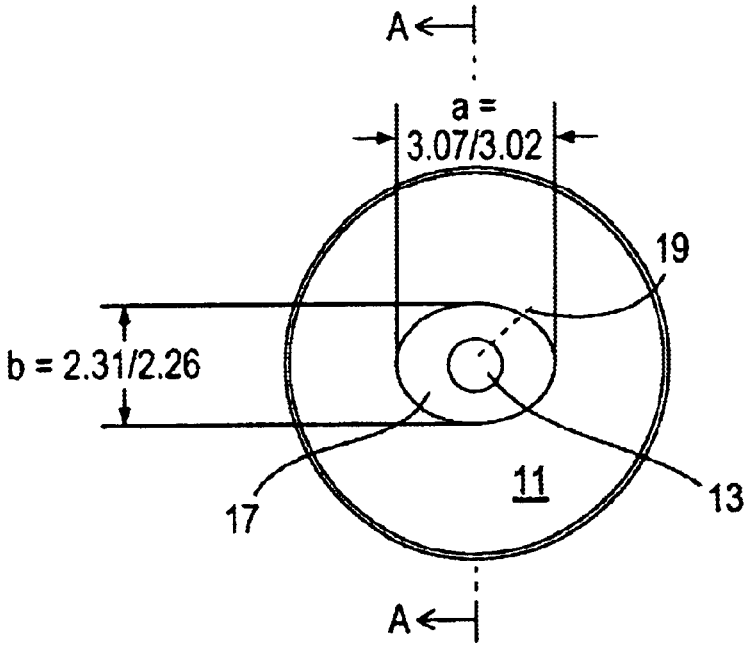
FIG. 2 is a front elevation view of the electrical feed-through device shown in FIG. 1 in the direction indicated by the arrow B in FIG. 1.

FIGS. 1 and 2 show a bent pin embodiment 10 of the hermetically sealed electrical feed-through device according to the invention. This electrical feed-through device includes a circular metal disk 11 provided with an oval or elliptical through-going hole or opening O positioned so that its center coincides with the center of the metal disk 11.

An angular or bent isolated pin 13 projects outward and rearward from the back of the circular metal disk 11. The isolated pin 13 is sealed in the oval or elliptical hole O in the circular metal disk 11 with a glass seal 17. The glass seal 17 fills the space between the isolated pin 13 and the metal disk 11 in the centered oval or elliptical hole or opening O. The isolated pin 13 has a circular transverse cross-section. The center of the front surface of the isolated pin 13 is arranged more or less exactly at the center of the oval or elliptical hole O in the embodiment shown in the drawing. The front surface of the isolated pin 13 is accessible or exposed on the front side of the circular metal disk 11.

An angular or bent ground pin 15 projects outward and rearward from the rear side of the circular metal disk 11 in an axial direction B indicated e.g. with the arrow in FIG. 1 shown on the front side of the metal disk 11 in FIG. 1. The ground pin 15 is bent in approximately the same shape as the isolated pin 13 at the bend b'. The ground pin 15 is attached to the rear surface of the circular metal disk 11 adjacent the oval or elliptical opening O by means of the braze ring 16 and is also called the braze pin.

Both the isolated pin 13 and the ground pin 15 are made of an electrically conductive metal, such as nickel-iron, and may be plated with another metal, such as gold or palladium, to provide corrosion protection.

In the embodiment shown in FIGS. 1 and 2 the isolated pin 13 and the ground pin 15 project outward and rearward from the rear side of the circular metal disk 11 and are approximately parallel to each other. The ground pin 15 is shorter than the isolated pin 13 so that the free ends of both pins are approximately or exactly the same distance from the rear side of the circular metal disk 11. In the embodiment shown in FIGS. 1 and 2 the end of the isolated pin 13 inserted in the glass seal 17 is more or less even or flush with the front surface of the circular metal disk 11 and the glass seal 17. The respective front surfaces of the circular metal disk 11, the glass seal 17 and the exposed end of the isolated pin 13 are approximately or exactly coplanar.

In use as part of an igniter a fine metal bridge wire 19 (shown with dashed lines in FIG. 2) extends across the front of the circular metal disk 11 and electrically connects the isolated pin 13 with the ground pin 15. The area across the front of the eyelet 11 where the fine metal bridge wire 19 is connected is called the bridge area, since the fine bridge wire 19 bridges the gap between the two pins. However the fine bridge wire 19 is not part of the present invention, and thus is shown with dashed lines. The electrical feed-through device is marketed separately without the fine bridge wire 19 to various manufacturers of the initiator or squib for the air bag inflation device. Conceivably the electrical feed-through device could have other applications besides air bag igniters.

The same hermetically sealed electrical feed-through device can be marketed to different manufacturers that require different lengths of the fine bridge wire 19 in their igniter devices, because the distance between the respective front surfaces of the isolated pin 13 and the circular metal disk 11 varies because the through-going hole, and thus the glass seal 17, is elliptical or oval. Thus the hermetically sealed electrical feed-through device of the present invention is advantageously a universal electrical feed-through device for air bag igniters of different manufacturers.

As shown in FIG. 2, there is a longer bridge area in which the distance across the glass seal 17 is greatest on the surface of the header assembly. There is also a shorter bridge area on the surface of the header assembly in which the distance across the glass seal 17 is the least. The fine wire 19 is shown in FIG. 2 at a position, where the distance across the glass seal is inbetween the shortest and the longest distance.

Thus the same hermetically sealed electrical feed-through device can be marketed to different manufacturers that require different lengths of fine wire 19 in their igniter devices. Thus the hermetically sealed electrical feed-through device of the present invention is advantageously a universal feed-through device for air bag igniters of different manufacturers. Advantageously the same length bridge wire can be welded in each of the four quadrants of the glass seal. Double bridge wires can be easily welded at the same time.

For example, the major axis a of the elliptical hole can range from 3.02 to 3.07 cm and the minor axis b of the elliptical hole can range from 2.26 to 2.31 cm. The thickness t of the metal disk is about 2.5 cm.

The glass seal 17 of the hermetically sealed electrical feed-through device of the present invention may be made by the methods disclosed in background section of the invention, especially those disclosed in U.S. Pat. No. 6,274,252 and U.S. Pat. No. 5,709,724. The inventive improvements in the feed-through devices claimed below reside primarily in the geometries selected for the pin cross-sections and/or the through-going openings.

While the invention has been illustrated and described as embodied in a hermetically sealed electrical feed-through device, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

I claim:

1. A hermetically sealed electrical feed-through device comprising an electrically conductive body (11) with an oval or elliptical through-going opening (O), said electrically conductive body having a front side and a rear side and a center of said oval or elliptical through-going opening (O) at least approximately coincides with a center of said electrically conductive body (11);

an electrically conductive angular or bent isolated pin (13) hermetically sealed centrally in said oval or elliptical through-going circular opening (O) by means of a glass seal (17), so that said angular or bent isolated pin (13) projects outward from said rear side of said electrically conductive body and so that one end of the angular or bent isolated pin is accessible from or exposed on said front side of said electrically conductive body (11); and an electrically conductive angular or bent ground pin (15) connected with the rear side of the electrically conductive body (11) adjacent to said oval or elliptical through-going opening, said electrically conductive angular or bent ground pin (15) having a substantially identical shape as said angular or bent isolated pin (13) and projecting outward from the rear side of the electrically conductive body (11) approximately parallel to the isolated pin;

wherein the oval or elliptical through-going opening (O) has a major axis (a) and a minor axis (b) such that different bridge wires of different lengths are connectable between the front side of the said electrically conductive body (11) and the one end of the straight isolated pin (13) accessible from or exposed on the front side of the electrically conductive body (11).

2. The hermetically sealed electrical feed-through device as defined in claim 1, wherein said electrically conductive body (11) is a circular metal disk.

3. The hermetically sealed electrical feed-through device as defined in claim 2, wherein said isolated pin (13) and said ground pin (15) are each made of metal and have a circular transverse cross-section, and wherein said ground pin (15) is shortened relative to said isolated pin (13), so that free ends of said isolated pin and said ground pin are at least approximately an identical distance from the rear side of said circular metal disk.

4. The hermetically sealed electrical feed-through device as defined in claim 2, wherein said one end of said angular or bent isolated pin (13), said glass seal (17) and said front side of said circular metal disk have respective front surfaces that are at least approximately even with each other or at least approximately coplanar.

5. The hermetically sealed electrical feed-through device as defined in claim 2, wherein said angular or bent ground pin (15) is connected to said circular metal disk by a brazing ring (16).

* * * * *